United States Patent [19]

Kusakawa et al.

[11] Patent Number: 4,927,467

[45] Date of Patent: May 22, 1990

[54] METHOD FOR PRODUCING THIN PLATE OF PHOSPHOR BRONZE

[75] Inventors: Takaji Kusakawa, 19-9, Saginomiya 1-chome, Nakano-ku, Tokyo; Katsuyoshi Wakamoto, Sagamihara; Mitsuyuki Imaizumi, Amagasaki, all of Japan

[73] Assignees: Mitsubishi Denki Kabushiki Kaisha; Takaji Kusakawa, both of Tokyo, Japan

[21] Appl. No.: 154,330

[22] Filed: Feb. 10, 1988

[30] Foreign Application Priority Data

Feb. 10, 1987 [JP] Japan ..... 62-29225

[51] Int. Cl.[5] ..... C22F 1/08

[52] U.S. Cl. ..... 148/3; 164/463; 164/485

[58] Field of Search ..... 148/3, 433; 420/472; 164/463, 485, 164

[56] References Cited

U.S. PATENT DOCUMENTS

| | | | |
|---|---|---|---|
| 4,518,029 | 5/1985 | Shibuya et al. | 164/463 |
| 4,586,967 | 5/1986 | Shapiro et al. | 148/433 |
| 4,716,956 | 1/1988 | Hoffman et al. | 164/480 |

FOREIGN PATENT DOCUMENTS

| | | | |
|---|---|---|---|
| 112324 | 9/1979 | Japan | 148/3 |

*Primary Examiner*—Robert McDowell

*Attorney, Agent, or Firm*—Oblon, Spivak, McClelland, Maier & Neustadt

[57] ABSTRACT

A method for continuous production of thin plate ingot of phosphor bronze by quenching molten metal of bronze, wherein molten metal of phosphor bronze is quenched at a rate of from $10^{2°}$ C./sec. to $10^{5°}$ C./sec. to thereby solidify the same, and then the solidified metal is continuously cooled to a normal temperature to thereby obtain a microstructure having a crystal grain size of 50 μm or below and in which appearance of the dendritic structure and the segregation layer is suppressed.

6 Claims, 5 Drawing Sheets

METHOD FOR PRODUCING THIN PLATE OF PHOSPHOR BRONZE

BACKGROUND OF THE INVENTION

1. Field of the Invention

This invention relates to a method for producing thin plate ingot of phosphor bronze by the quench-solidification method.

2. Description of Background

As the method for producing ingot of phosphor bronze, there has so far been practiced generally a continuous casting by means of a horizontal continuous casting apparatus. As an example, FIG. 5 of the accompanying drawing is a schematic cross-sectional view showing a conceptual structure of the conventional horizontal continuous casting apparatus as disclosed in Japanese Unexamined Patent Publication No. 38639/1983. In the drawing, a reference numeral 1 designates melt of a metal which has been molten by, for example, a melting furnace (not shown in the drawing) operated by electric power such as high frequency electromagnetic waves, and so forth; a numeral 2 refers to a holding furnace for maintaining the melt in its constant state and quantity; a numeral 3 refers to a graphite mold fixedly provided at the lower end part of the holding furnace; a reference numeral 4 denotes a water-cooling jacket provided on and around the graphite mold in a manner to surround the same; and a reference numeral 5 represents traction rollers to draw out an ingot 6 which has resulted from the melt 1 due to its cooling and solidifying.

In the casting apparatus of the above-described construction, the melt 1 which has been stored in the holding furnace 2 is poured into the graphite mold 3 and becomes solidified under the cooling effect of a cooling water which flows in an through a water passageway formed in the interior of the water-cooling jacket 4, and is finally taken out of the mold 3 in the form of the ingot 6. At that time, the ingot 6 is drawn out by the traction rollers either intermittently or continuously, whereby a long, continuous ingot 6 is obtained. After this, the ingot is subjected to repeated rolling and annealing processes to be finished into a thin plate having a predetermined size.

FIG. 6 of the accompanying drawing is a micrograph (magnification: 50 times) of a metal structure of the ingot 6, in its cross-section, obtained by casting the melt 1 having a composition of 8% by weight of Sn, 0.15% by weight of P, and a balance of Cu, in accordance with the above described casting method.

FIG. 7 of the accompanying drawing is a graphical representation showing changes in density of Sn in relation to cutting distance from the surface of the above-mentioned ingot, the analysis of Sn being effected by use of the fluorescent X-ray at a position where the surface of the ingot has been cut.

Further, FIG. 8 of the accompanying drawing is a graphical representation showing distribution in density of Sn as analyzed by an electron probe microanalyzer (EPMA) in the cross-section of the above-mentioned ingot.

From these results of analyses, it can be verified that the ingot obtained by the conventional method indicates a columnar crystal structure having the dendritic structure as shown in FIG. 6, that a surface segregation of Sn appears as shown in FIG. 7, and that density of Sn within the crystal structure varies conspicuously as shown in FIG. 8. Accordingly, in order to improve its roll-processability which is the essential requirement for producing a long web of thin plate product, it has been indispensable to subject the ingot to a homogenizing heat-treatment at a high temperature and for a long period of time to thereby render uniform the density of Sn for effecting the necessary processing. On account of this, the annealing and rolling processes have to be done until such time the ingot is finished to a predetermined size, which inevitably consumes a great deal of energy for the manufacture of the thin plate product.

SUMMARY OF THE INVENTION

The present invention has been made with a view to solving the points of problem as mentioned above, and aims at establishing an improved method for producing a thin plate of phosphor bronze from an ingot which is free from a segregation layer, has favorable roll-processability without subjecting it to a homogenizing heat-treatment at a high temperature and for a long period of time, and is processable with less amount of energy.

According to the present invention, in general aspect of it, there is provided a method for producing a thin plate of phosphor bronze by quenching molten metal of phosphor bronze to continuously producing an ingot of the thin plate, said metal comprising steps of: quenching said molen metal at a cooling rate in a range of from $10^2$ °C./sec. to $10^5$ °C./sec. to solidify the molten metal; and then continuously cooling the solidified metal material to a normal temperature, thereby rendering the crystal grain size to be 50 um or less and suppressing appearance of the dendritic structure and the segregation structure.

The foregoing object, other objects as well as specific way of producing the thin plate ingot of phosphor bronze according to the present invention will become more apparent and understandable from the following detailed description thereof, when read in conjunction with the accompanying drawing.

BRIEF DESCRIPTION OF THE ACCOMPANYING DRAWING

In the drawings:

FIG. 1 is a schematic conceptual diagram of a double-roll type metal quench-casting apparatus to attain one embodiment of the present invention;

FIGS. 2 to 4 illustrate the state of the ingot obtained by the method of the present invention, wherein FIG. 2 is a micrograph (magnification: 50 times) of a metal structure of the ingot in its cross-section. FIG. 3 is a graphical representation showing distribution in density of Sn from the surface of the ingot, and FIG. 4 is a graphical representation showing fluctuation in density of Sn from the surface of the ingot;

FIG. 5 is a schematic cross-sectional view of a conventional horizontal, continuous casting apparatus; and FIGS. 6 to 8 also show the states of the ingot obtained by the conventional casting method, in which FIG. 6 is a micrograph of a metal structure, FIG. 7 is a graphical representation showing distribution of Sn, and FIG. 8 is a graphical representation showing fluctuation in density of Sn.

DESCRIPTION OF PREFERRED EMBODIMENT

In the following, the present invention will be described in relation to a casting apparatus for realizing one preferred embodiment of the casting method.

Figure 1:
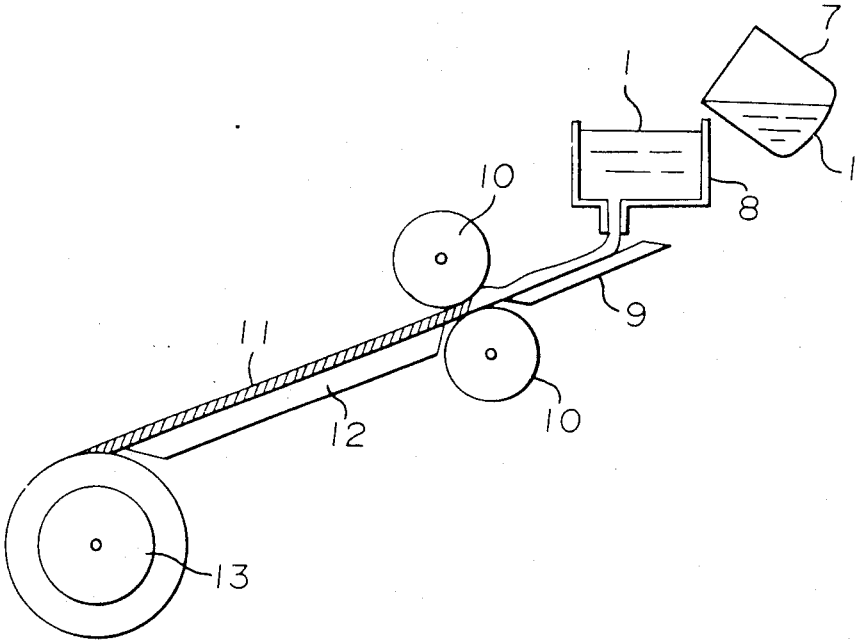

Referring to FIG. 1, which illustrates a conceptual structure of a double-roll type metal quench-casting apparatus for putting the present invention into practice, a reference numeral 7 designates a ladle for pouring melt 1 of a metal which has been melted in a melting furnace (not shown in the drawing); a numeral 8 refers to a reservoir for storing the metal melt 1 in it; a numeral 9 refers to a launder for leading the melt 1 flowing out of the reservoir to a predetermined location, which is provided with a heat-insulating means to prevent the melt 1 from solidification; a reference numeral 10 denotes a pair of cooling rollers which are disposed in an upper-lower positional relationship with a variable space gap being provided between them, and are cooled for water, the rotational speed thereof being also made variable arbitrarily; a reference numeral 11 represents an ingot which can be formed by passage of the melt 1 through the cooling rollers 10, the ingot being in the form of thin plate as the object of the present invention; and a reference numeral 12 designates a guide member for guiding the above-mentioned thin plate ingot to a winding device 13 for taking it up thereon.

In the metal quench-casting apparatus of the above described construction, the melt 1 is fed to a space gap formed between the pair of cooling rollers 10, 10 from the reservoir 8 through the launder 9, in which the melt 1 becomes solidified instantaneously to be the thin plate ingot 11. The ingot 11 then slides on the guide 12 and is sent to the winding device 13, on which it is taken up continuously.

With a view to verifying the effect according to the present invention, the present inventors conducted experimental production of the ingot by use of an experimental facility consisting of cast iron rollers having a diameter of 200 mm and internally cooled with water, as the cooling rollers 10, and under the production conditions such that number of revolution of the cooling rollers 10 to 10 rpm and the pouring temperature of the melt to the rollers 1,070° C. As the result, there could be obtained a thin plate phosphor bronze ingot having a dimension of 2 mm thick and 100 mm wide.

Figure 2:
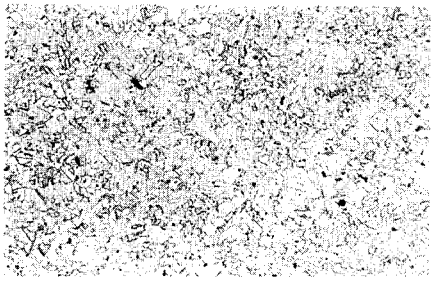
Figure 6:
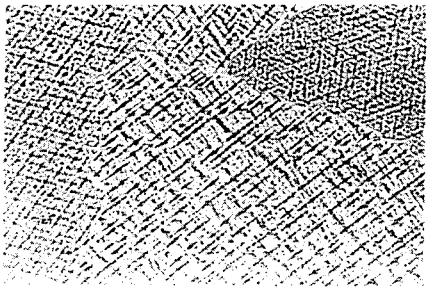
FIG. 6 PRIOR ART

FIG. 2 shows a micrograph of a metal structure, taken at the cross-section, of the ingot obtained by casting a melt composed of 8% by weight of Sn, 0.15% by weight of P, and a balance of Cu, in the same manner as in the conventional method (magnification: 50 times).

Figure 3:
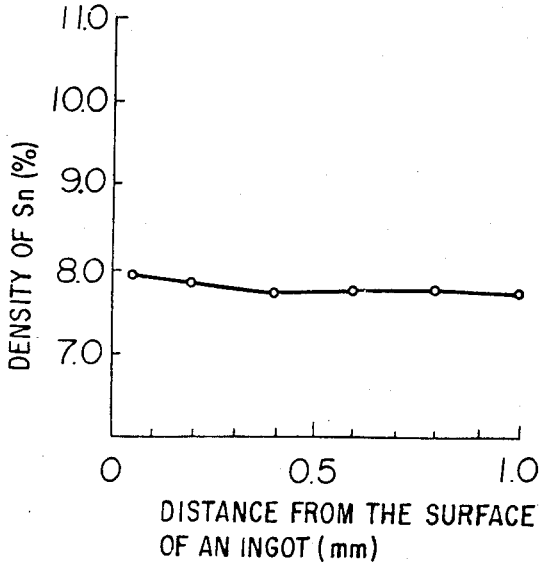

FIG. 3 indicates the results of analysis of Sn by the fluorescent X-ray at a position where the surface of the ingot is cut.

Figure 4:
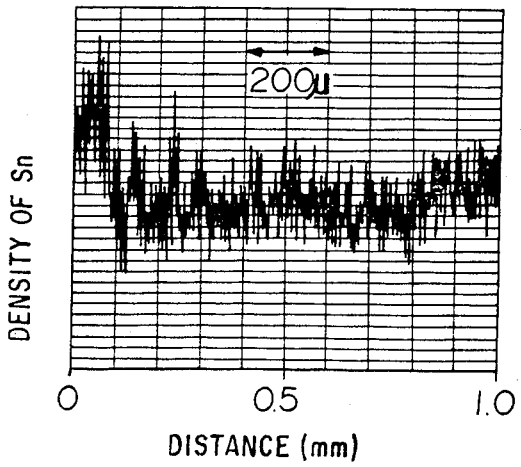
Figure 5:
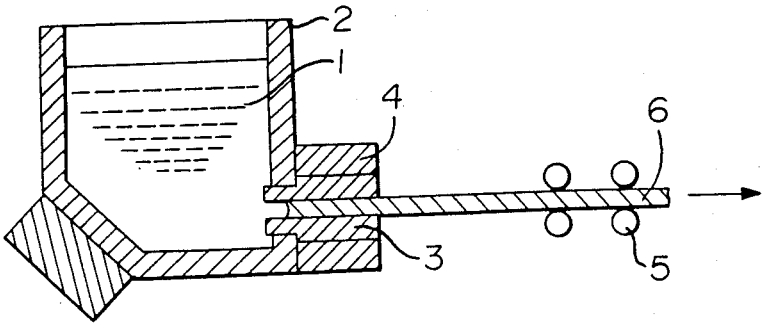
FIGURE 5 PRIOR ART
Figure 7:
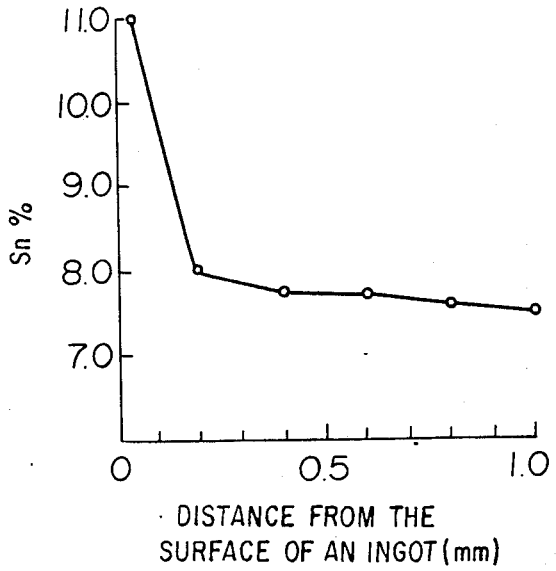
FIGURE 7 PRIOR ART
Figure 8:
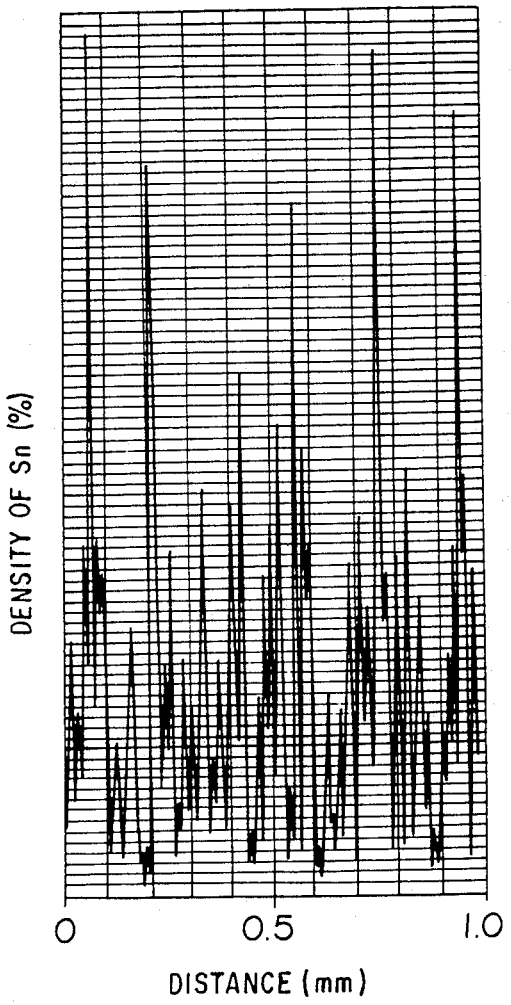
FIGURE 8 PRIOR ART

Further, FIG. 4 is a graphical representation showing the result obtained from analysis of the density distribution of Sn by the EPMA (electron probe microanalyzer) in the above-mentioned ingot in its cross-section.

Upon comparison of these results with those obtained by the conventional casting method, difference between the present invention and the conventional method can be recognized clearly. That is to say, it is seen that, as shown in FIG. 2, with the crystal grain size of 50 μm or below, the ingot of the present invention possesses the microstructure, in which the appearance of dendritic structure is suppressed. Moreover, from FIG. 3 and 4, it is seen that no fluctuation exists in the density of Sn, and that appearance of the segregation layer is suppressed.

From the foregoing description, the quenching of the molten metal of phosphor bronze would result in an ingot having a microstructure, in which the crystal grain size is 50 μm or below, the appearance of the dendritic structure is suppressed, and further the appearance of the segregation layer of Sn is suppressed.

By the way, the reason for limiting the cooling rate in a range of from $10^2$ C./sec. to $10^5$ °C./sec. is that, as the result of various experiments, it has been found out that, with the cooling rate not reaching $10^2$ °C./sec., the microstructure of the ingot makes no change from the conventional ingot, while, with the cooling rate exceeding $10^5$ °C./sec., the gauge of the plate ingot becomes extremely thin to be incapable of practical use.

In the above described example, there has been shown a case, in which phosphor bronze is composed of 8% by weight of Sn, 0.15% by weight of P, and a balance of Cu. It should, however, be noted that same effect can be exhibited with phosphor bronze composed of 0.1 to 9.0% by weight of Sn, 0.03 to 0.35% by weight of P, and a balance of Cu and unavoidable impurities.

Furthermore, as one example of practicing the method of the present invention, use is made of an apparatus as shown in FIG. 1. It should, however, be noted that the present invention is not limited to this embodimental apparatus alone.

As has so far been described, according to the present invention, by the quench-solidification of the melt of phosphor bronze, it becomes possible to obtain the continuous thin plate ingot, in which the crystal grain size is 50 μm or below, appearance of the dendritic structure has been suppressed, and, in addition, no segregation layer of Sn is observed. On account of this, the ingot exhibits favorable processability and is capable of roll-processing at 80% and above without necessity for subjecting it to the homogenizing heat-treatment. Moreover, since the ingot can be obtained in near proximity to the gauge of the intended thin plate product, the processing steps and heat-treating steps can be reduced considerably, whereby remarkable effect can be exhibited due to saving of energy.

Although, in the foregoing, the present invention has been described with particular reference to the preferred embodiment thereof, it should be understood that any changes and modifications may, of course, be made by those persons skilled in the art without departing from the spirit and scope of the invention as recited in the appended claims.

What is claimed is:

1. A method for continuous manufacture of thin plate ingot of phosphor bronze composed of 0.1 to 9.0% by weight of Sn, 0.03 to 0.35% by weight of P, and the balance being Cu and unavoidable impurities, by quenching molten metal of bronze, which comprises the steps of: quenching said molten metal at a cooling rate in a range of from $10^2$ °C./sec. to $10^5$°C./sec. to thereby solidify the molten metal; and continuously cooling said solidified metal to a normal temperature to thereby obtain a microstructure having a crystal grain size of 50 μm or below and in which appearance of the dendritic structure and the segregation layer is suppressed.

2. A method according to claim 1, wherein quenching of said molten metal at said cooling rate is effected by a cooling roller .

3. A method according to claim 2, wherein said cooling roller is cooled with water.

4. A method according to claim 2, wherein said cooling roller comprises upper and lower rollers.

5. A method according to claim 2, wherein said molten metal is maintained in a molten state until it is carried to said cooling roller.

6. A method according to claim 1, wherein said thin plate ingot of phosphor bronze as solidified is continuously taken up on a winding device.

* * * * *